US005499220A

United States Patent [19]

Ogasawara

[11] Patent Number: 5,499,220

[45] Date of Patent: Mar. 12, 1996

[54] ELECTRONIC TIMEPIECE

[75] Inventor: Kenji Ogasawara, Chiba, Japan

[73] Assignee: Seiko Instruments Inc., Japan

[21] Appl. No.: 325,810

[22] Filed: Oct. 19, 1994

[30] Foreign Application Priority Data

Nov. 5, 1993 [JP] Japan ..... 5-276705
Aug. 10, 1994 [JP] Japan ..... 6-188595

[51] Int. Cl.[6] ..... G04B 19/22
[52] U.S. Cl. ..... 368/21
[58] Field of Search ..... 368/21–27

[56] References Cited

U.S. PATENT DOCUMENTS 3,653,204 4/1972 Miwa .
4,316,272 2/1982 Naito ..... 368/21
4,896,307 1/1990 Marx et al. ..... 368/70
5,237,544 8/1993 Sase et al. ..... 368/21

*Primary Examiner*—Vit W. Miska
*Attorney, Agent, or Firm*—Adams & Wilks

[57] ABSTRACT

An electronic timepiece, to display always accurate current local time by city without any change-over to and from the summer time.

In an electronic timepiece, to adjust time automatically at change-over to and from the summer time, comprising a city's summer time date memory means 111 for memorizing the starting, the ending and etc. date value by city, a summer time period comparing means 107 for judging if in the summer time through comparing the time calculated by city's current time calculating means 106 with the summer time value memorized in the city's summer time date memory means 111, a time adjusting means 108 for adjusting time when judged by the summer time period comparing means 107 that it is in the summer time, and a displaying means 109 for displaying time.

5 Claims, 16 Drawing Sheets

FIG. 14

| NAME OF THE CITY | STARTING DATE OF SUMMER TIME | ENDING DATE OF THE SUMMER TIME |
|---|---|---|
| LONDON | LAST SUNDAY IN MARCH | LAST SUNDAY IN OCTOBER |
| PARIS | LAST SUNDAY IN MARCH | LAST SUNDAY IN SEPTEMBER |
| NEW YORK | FIRST SUNDAY IN APRIL | LAST SUNDAY IN OCTOBER |

ELECTRONIC TIMEPIECE

This invention relates to an electronic timepiece characterized in that time adjustment is automatically made at the timing when it enters into or gets out of the summer time through memorizing the starting and the ending date value, etc. by city.

In prior art, there exists the following two methods;

FIG. 10 shows a "World Time" timepiece in prior art, comprising a dividing circuit 1002 for dividing the standard signal from an oscillating circuit 1001, time counting means 1003 for counting the time with the signal from the oscillating circuit 1002, date counting means 1004 for counting the date with the signal from the time counting means 1003, city selecting means 1005 for selecting the city, city's current time calculating means 1006 for calculating the local time of the city selected by the city selecting means 1005 with the time counting means 1003 and the date counting means 1004, summer time adjusting means 1008 for adding an hour to or subtracting an hour from the time calculated by city's current time calculating means 1006 at the time of changing over to or from the summer time, and a displaying means 1007 for displaying the time.

FIG. 11 shows a "Summer Time" timepiece in prior art, comprising a dividing circuit 1102 for dividing the standard signal from an oscillating circuit 1101, time counting means 1103 for counting the time with the signal from the dividing circuit 1102, date counting means 1104 for counting the date with the signal from the time counting means 1103, summer time value setting means 1106 for setting the value of the starting or the ending of the summer time, summer time value memory means 1108 for memorizing the value set by the summer time value setting means 1106, summer time period comparing means 1107 for judging if it is the summer time, through comparing the summer time value memorized in the summer time value memory means 1108 with the current time counted by the time counting means 1103 and the date counting means 1104, and displaying means 1105 for displaying the time.

There exists a demerit in the "World Watch" above in prior art that a special switch button for changing over for and from summer time period is necessary and also a demerit in the "Summer Time" watch above in prior art that its user has to remember beforehand the starting and the ending date of the Summer Time by city and to change it over using a specialized change over button for obtain the correct time.

And the user above has to input the data above after finding such date value when he has to use the watch in different location cities.

SUMMARY OF THE INVENTION

The object of this invention is to eliminate the troublesome handling for adjustment as above through having the watch memorized beforehand summer time date value by city and therefore to obtain always correct current time by city.

In order to solve the problems that a special switch button as for change-over means of summer time is necessary for the "World Watch" in prior art and that the troublesome input handling by users in necessary for the "Summer Time" watch in prior art that users has to know summer time date values by city beforehand and to input them beforehand, an electronic timepiece in this invention equips such a structure for automatic adjustment at the timing to and from the summer time as there exist city's current time calculating means for calculating the local time at the city selected by the city selecting means with the output signal from the time counting means and the output signal from the date counting means, city's summer time memory means for memorizing such a information as the starting and the ending date of the summer time by city etc., summer time comparing means for judging if it is in the summer time period through comparing the time counted by the city's current time calculating means with the summer time value memorized in the city's summer time date memory means, time adjusting means for adjusting the time in case judged by the summer time comparing means that it is the summer time, and a displaying means for displaying the adjusted time above.

FIG. 1 shows a block diagram of a representative example of a structure of this invention.

The standard signal from the oscillating circuit 101 is divided by the dividing circuit 102. Time counting means 103 counts time with the divided signal. Receiving the signal that the date is changed from the counting means 103, date counting means 104 counts date. City designating means 110 designates the selected city by the city selecting means 105.

The local time by city selected beforehand is calculated by the city's current time calculating means 106, based on the data from the time counting means 103 and the data counting means 104.

The time by city calculated by the city's current time calculating means 106 is compared by the summer time comparing means 107 with such date value as the starting, the ending date, etc. of summer time by city memorized in the city's summer time date memory means 111. In case it is judged in the comparison above that it is in the summer time, the time difference is compensated by the time adjusting means 108 and in case not, then without any compensation above. After this, the time is adjusted by the time adjusting means 108 and the result is displayed by the displaying means 109.

FIG. 2 shows another block diagram of a representative example of a structure of this invention.

The standard signal from the oscillating circuit 201 is divided by the dividing circuit 202. Time counting means 203 counts time with the divided signal. Receiving the signal that the date is changed from the counting means 203, the date counting means 204 counts date. City selecting means 205 selects city according to the input from the city designating means 210. Concerning the time difference of a city selected by the city selecting means 205, the time difference from the home time is calculated by city's time difference calculating means 212, based on the time difference value by city memorized in the city's time difference value memory means 214.

The local time by city selected beforehand is calculated by the city's current time calculating means 206, based on the data from the time counting means 203 and the date counting means 204. The time by city calculated by the city's current time calculating means 206 is compared by the summer time period comparing means 207 with such date value as the starting, the ending date, etc. of summer time by city memorized in the city's summer time date memory means 211. In case judged in the comparison above that it is in the summer time, the time difference is compensated by the time difference compensating means 213 and in case not, then without any compensation above. After this, the time is adjusted by the time adjusting means 208 and the result is displayed by the displaying means 209.

BRIEF DESCRIPTION OF THE DRAWING

FIG. 14 shows a table of the starting and the ending date of the summer time by city.

DETAILED DESCRIPTION OF THE PREFERRED EMBODIMENTS

Hereinafter is explained in detail this invention according to the drawings.

(1) The first embodiment

Figure 1:
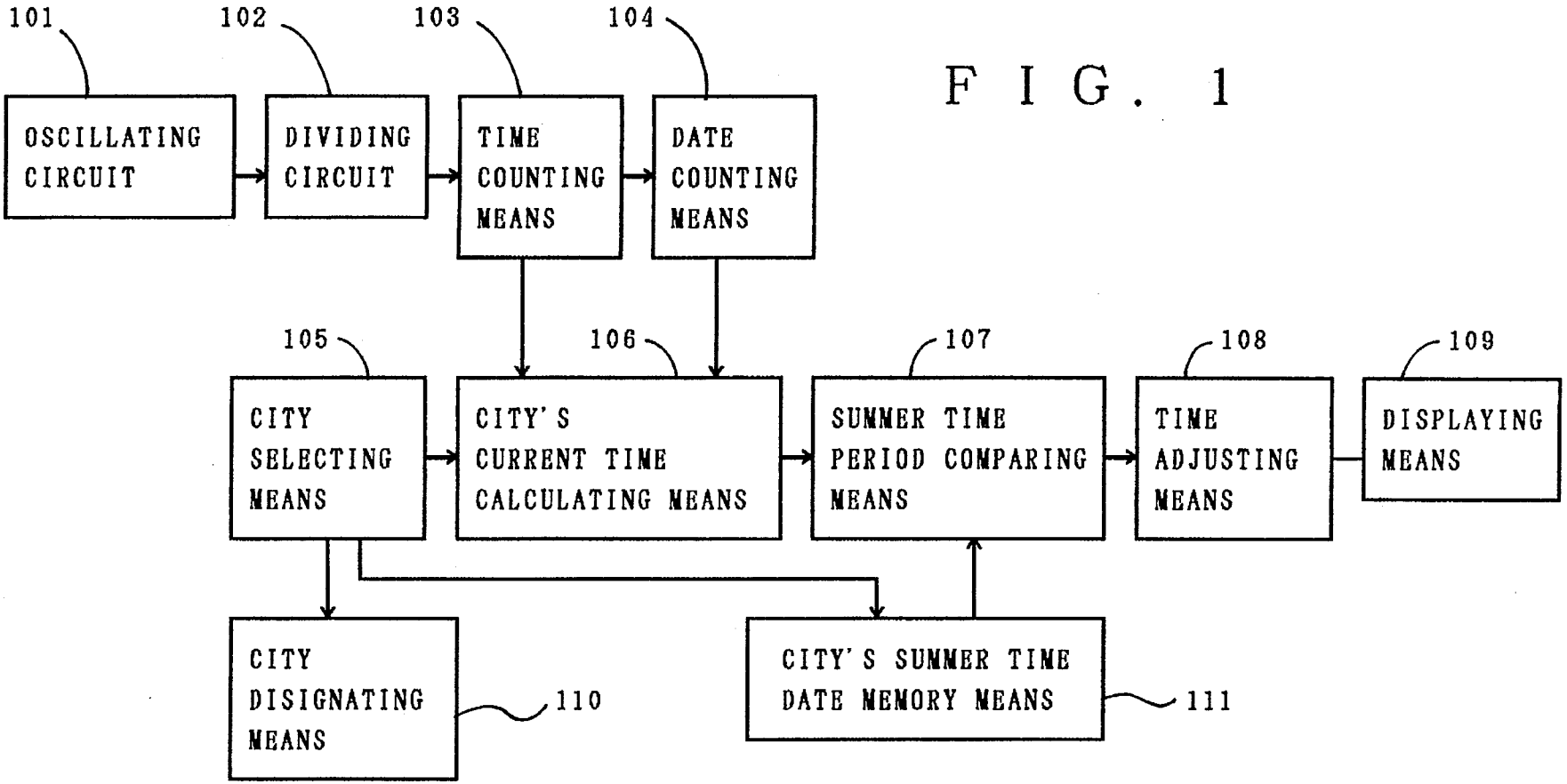
FIG. 1 shows a functional block diagram of a representative structure of an electronic timepiece in this invention.
Figure 2:
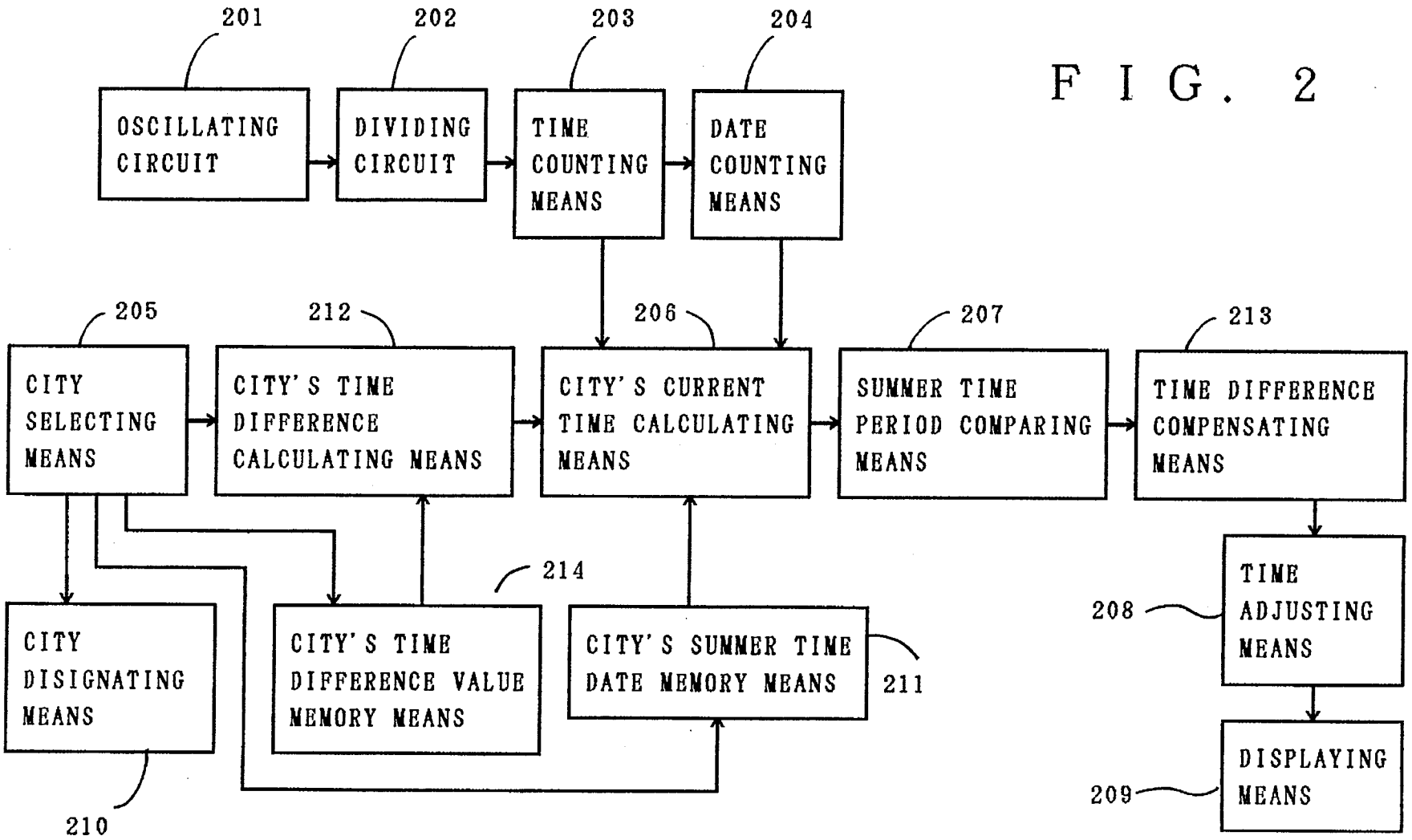
FIG. 2 shows a functional block diagram of a representative structure of an electronic timepiece in this invention.
Figure 3:
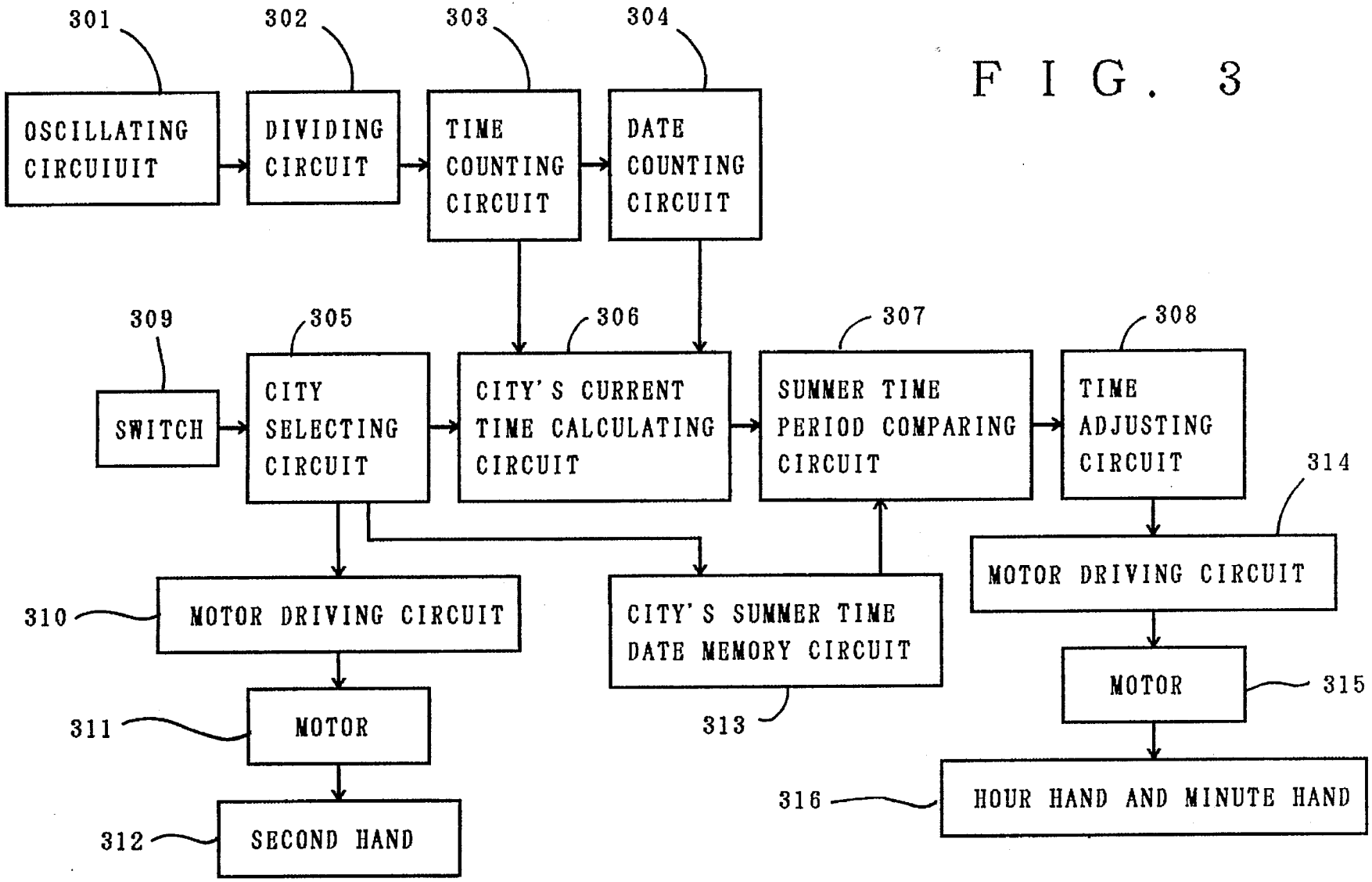
FIG. 3 shows a functional block diagram of an electronic timepiece as is the first embodiment in this invention.

The FIG. 3 shows a block diagram of an analogue watch with two or more motors in the first embodiment of a electronic timepiece in this invention.

In FIG. 3, the standard signal from the oscillating circuit 301 is divided by the dividing circuit 302. Time counting means 303 counts time with the divided standard signal above. Receiving the signal from the time counting circuit 303 that the date is changed, the date counting circuit 304 counts date. The city selecting circuit 305 selects city, based on the input from the switch 309, and the motor 311 is driven by the motor driving circuit 310. As a result, a city selected as a above out of the cities is designated with the second hand 312, of which name is printed on the bezel 1201 as shown in the FIG. 12.

Figure 12:
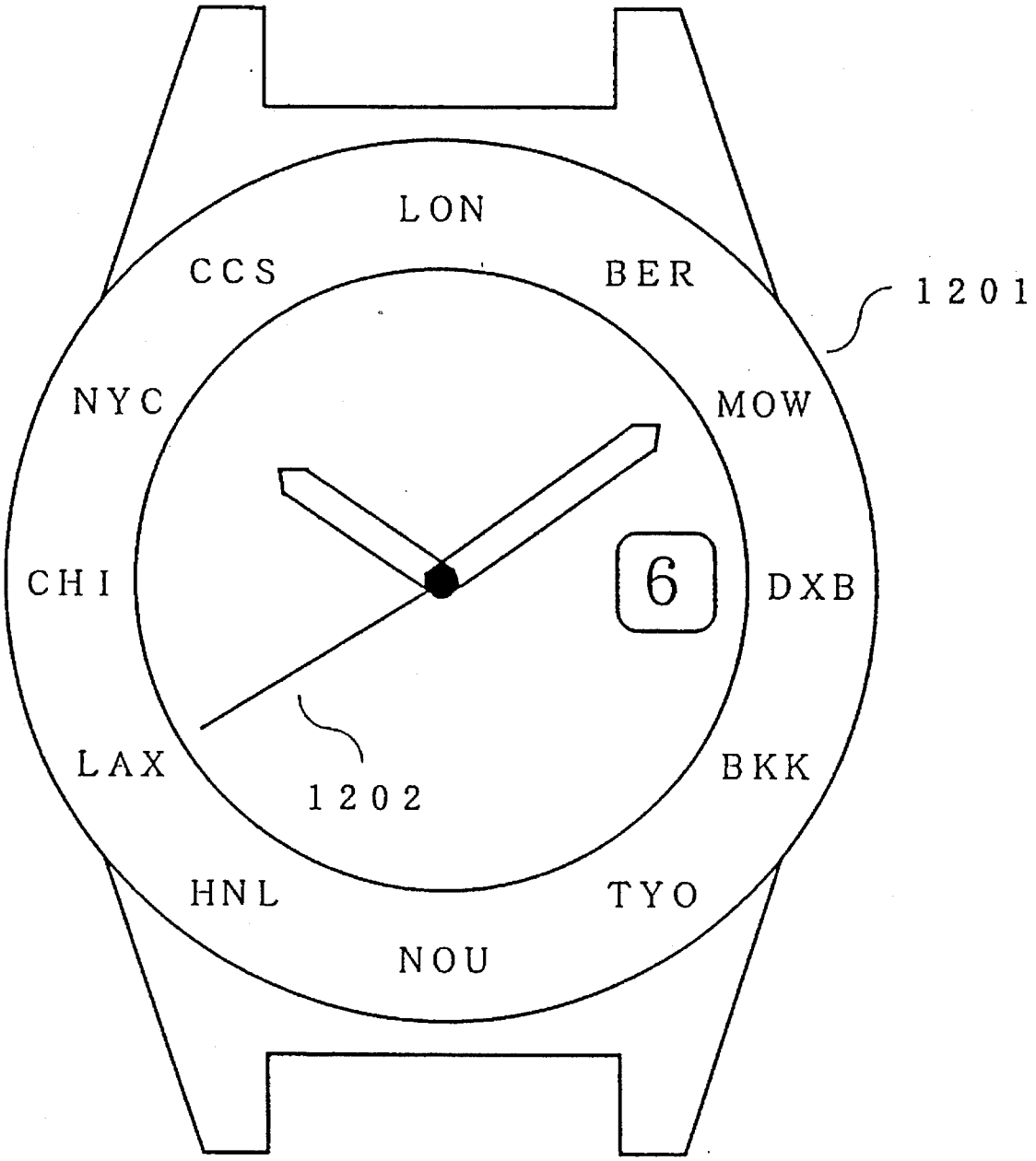
FIG. 12 shows a plain view drawing of an electronic timepiece as is the first embodiment in this invention.

Referring to the FIG. 12, the second hand 1202 designates LAX(Los Angeles). The local time of the city selected by the city selecting circuit 305 is calculated by the city's current time calculating circuit 306, based on the values from the time counting circuit 306 and the date counting circuit 304. The time of the city calculated by the city's current time calculating circuit 306 is compared by the summer time period comparing circuit 307 with the date values such as the starting, the ending, and etc. of the summer time by city memorized in the city's summer time date memory circuit 313. In case it is judged that it is in the summer time, time above is adjusted by the time adjusting circuit 308. And then the motor 315 is driven by the motor driving circuit 314, and hour hand and minute hand 316 are shifted to the position which shows the current local time of the city.

The hour hand, the minute hand, and the second hand can be driven by separate motors respectively or by the first motor for the hour hand and the minute hands and by the second motor for the second hand, in this invention.

Figure 5:
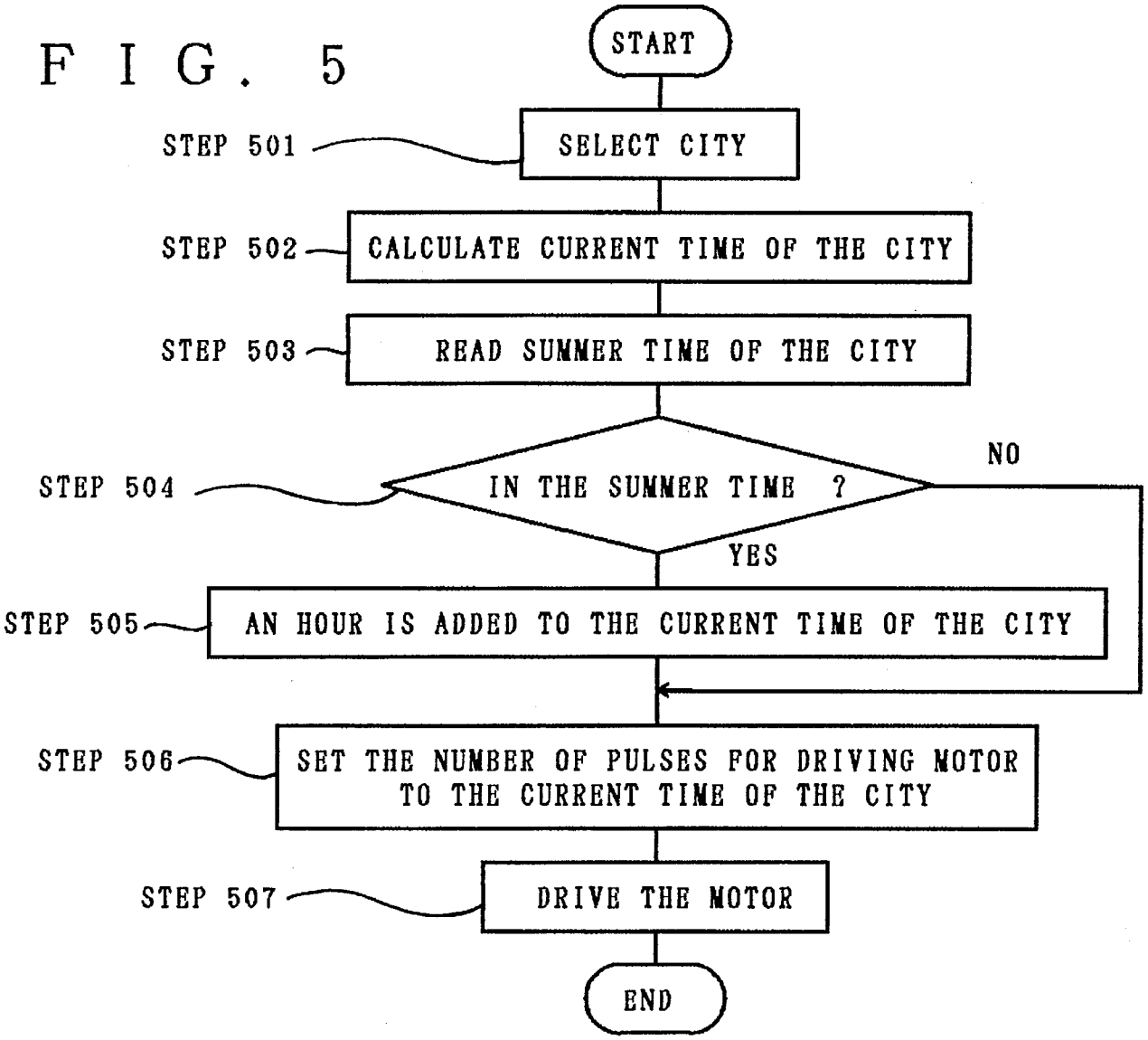
FIG. 5 shows a flow chart of an electronic timepiece as is the first embodiment in this invention.

FIG. 5 shows a flow chart of the first embodiment of an analogue electronic timepiece in this invention.

A city is selected (step 501).

Current time of the city above is calculated(step 502).

The summer time value of the city is read (step 503).

The current time above with the summer time value above is compared and goes to the step 505 in case judged that it is in the summer time or goes to 506 in case not. (step 504)

An hour is added to the current time in case judged that it is in the summer time in the step 504. (step 505)

Number of pulses for driving motor to the current time position of the city is set (step 506).

The motor is driven and the current time of the city is displayed with the hour hand and the minute hand (step 507).

Figure 6:
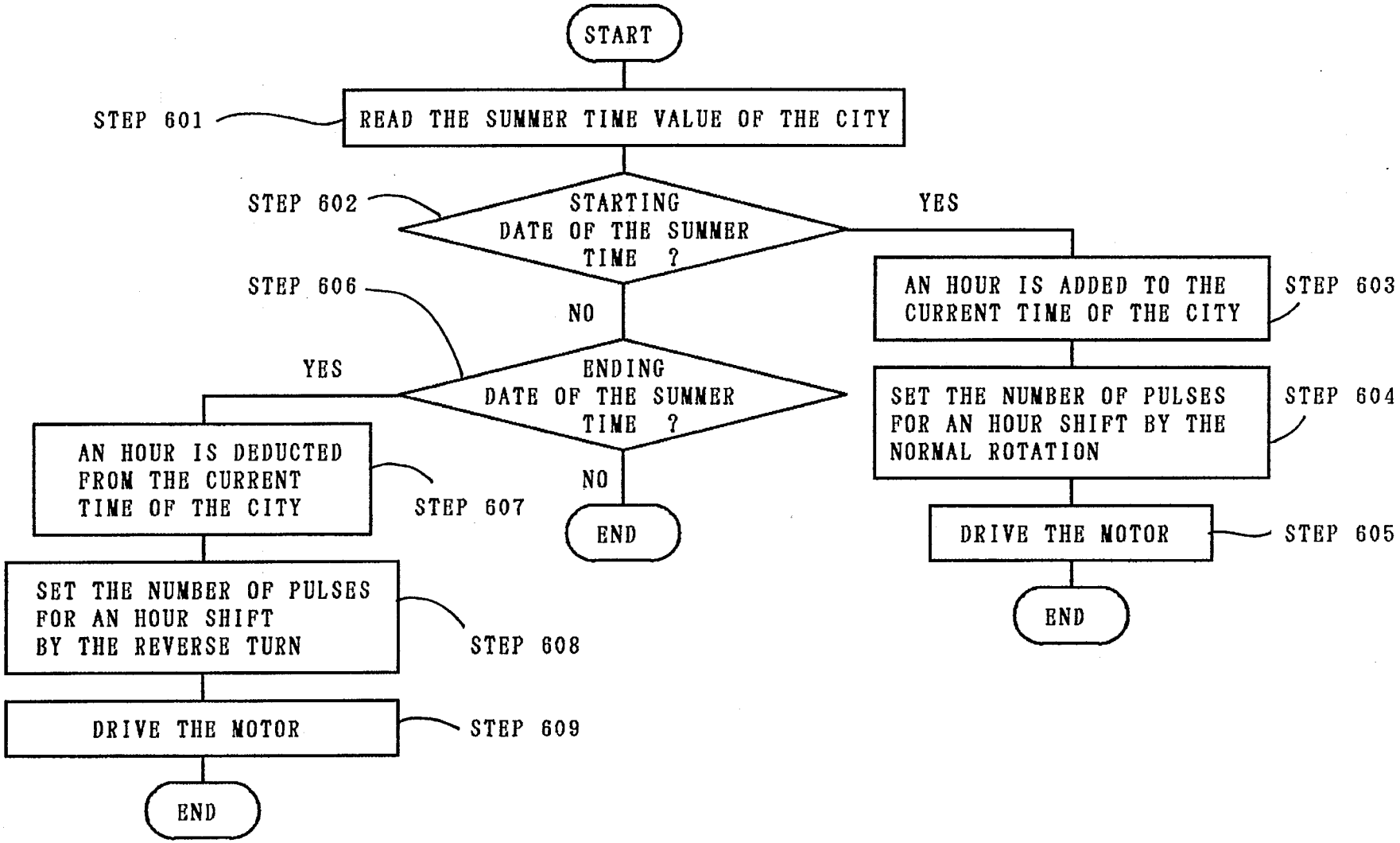
FIG. 6 shows a flowchart of an electronic timepiece as is the first embodiment in this invention.

The activity in the FIG. 6 in executed in case the date at the city coincides with the starting date or the ending date of the summer time through the counting in the time counting circuit 303 and the date counting circuit 304.

The summer time value of the city is read (step 601).

The activity at step 603 is executed in case the date at the city coincides with the starting date of the summer time at the city, or the activity at step 606 in executed in case not. (step 602).

An hour is added to the current time of the city in case judged that it coincides with the starting date of the summer time at step 602 (step 603).

The number of pulses for an hour shift by the normal rotation of the motor. (step 604)

The time where an hour is added which means in the summer time, is displayed with the hour hand and the minute hand through the driving of the motor. (step 605)

The activity at step 607 is executed in case it is judged that it coincides with the ending date of the summer time at the city or the activity comes to an end in case not, after judged at step 602 that it does not coincide with the starting date thereof (step 606).

An hour is deducted from the current time at the city, in case it is judged at step 606 that it coincides with the ending date thereof (step 607).

The number of pulses is set for the reverse turn shift of the motor by an hour (step 608).

The ordinary time at the ending thereof is displayed with the hour hand and the minute hand by driving motor (step 609).

FIG. 14 shows the table of the starting and ending data of the summer time by city, which are memorized in the summer time memory circuit 313.

In FIG. 14, picking up a sample at New York, the starting date thereof is the first Sunday in April and the ending date thereof is the last Sunday in October.

Figure 15:
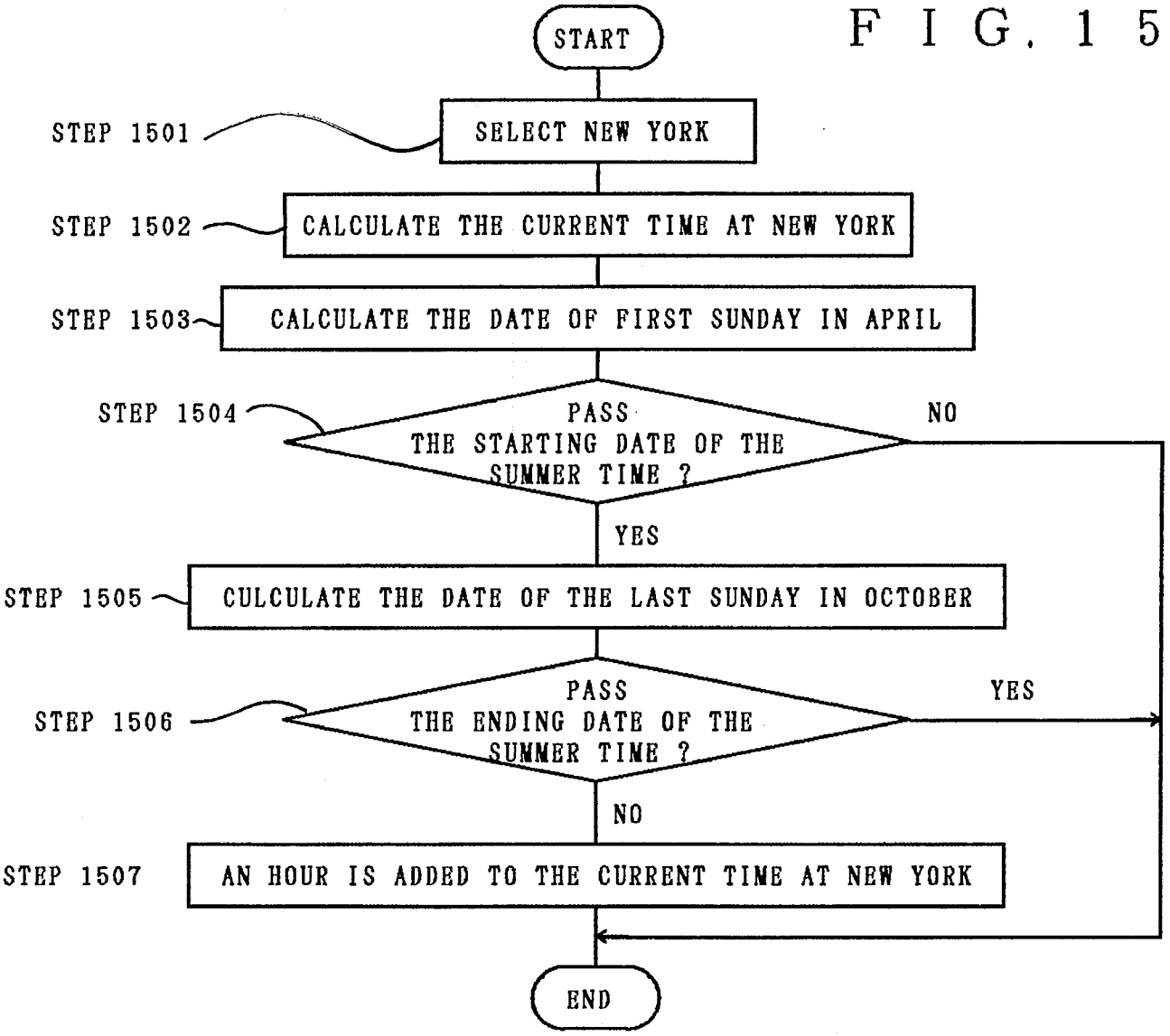
FIG. 15 shows a flow chart of an electronic timepiece as is the first embodiment in this invention.

FIG. 15, shows a flowchart for the summer time period comparison in the first embodiment of an analogue electronic timepiece in this invention, picking up a sample at New York.

In FIG. 15, the city of New York is selected (step 1501).

The current time at New York is calculated (step 1502).

The date of the first Sunday in April is calculated (step 1503).

The activity at step 1505 is executed in case it is judged that the current date has passed the starting date of the summer time by means of comparing both above, and the activity comes to an end in case not (step 1504).

The last Sunday in October is calculated in case it is judged at step 1504 that the current date has passed the starting date thereof (step 1505).

The activity at step 1507 is executed in case it is judged that the current date above has not passed the ending date thereof by means of comparing both above, and the activity comes to an end in case it has already passed (step 1506).

An hour is added to the current time at New York in case the current date does not pass the ending date thereof in step 1506 (step 1507).

(2) The second embodiment.

Figure 4:
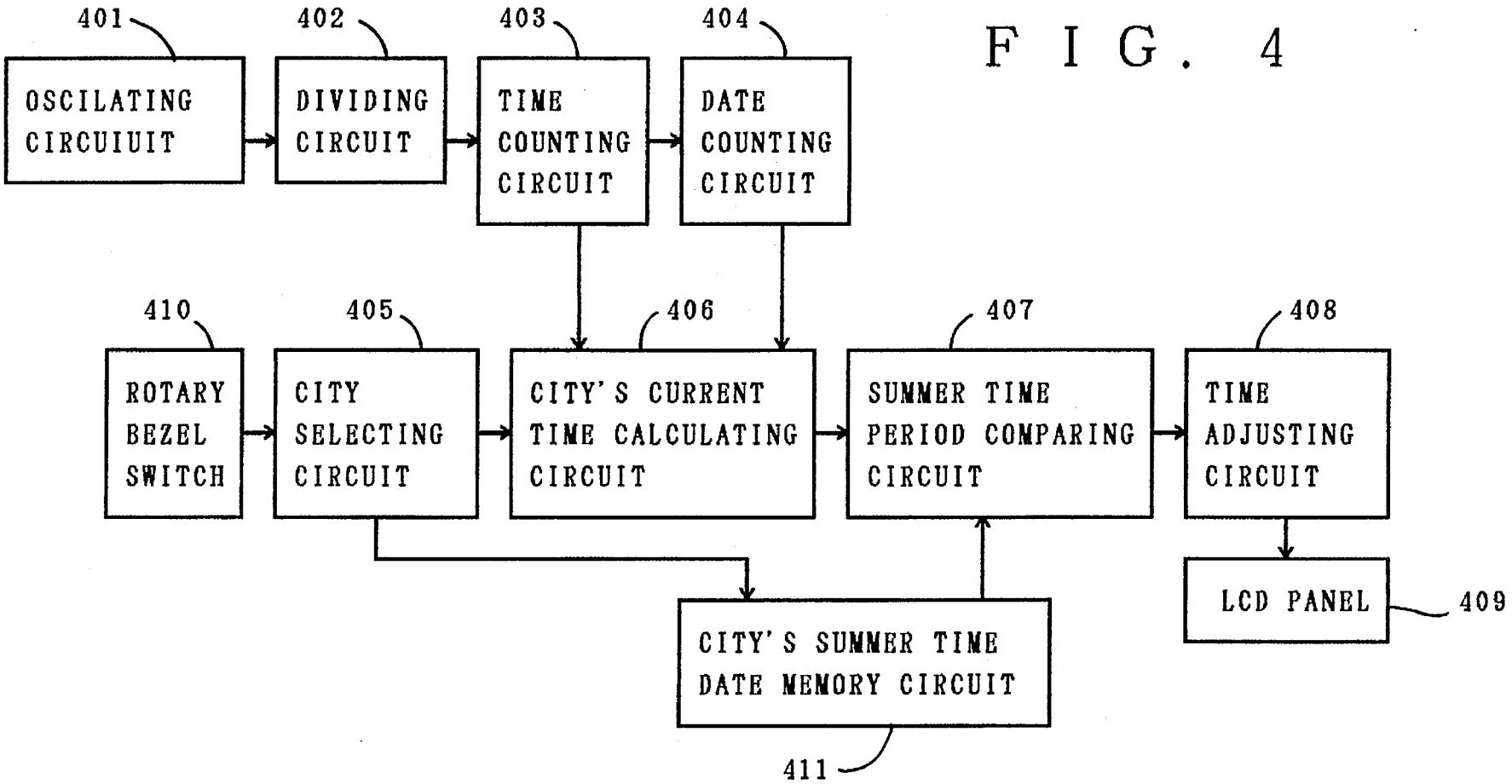
FIG. 4 shows a functional block diagram of an electronic timepiece as is the second embodiment in this invention.

FIG. 4 shows a block diagram of a digital electronic timepiece in this invention as is the second embodiment.

In FIG. 4, the standard signal from the oscillating circuit 401 is divided by the dividing circuit 402. The time counting circuit 403 counts time with the divided signal above. Receiving the date signal from the time counting circuit 403, the date counting circuit 404 counts date. The city selecting circuit 405 selects a city according to the input from the rotary bezel switch 410.

Figure 13:
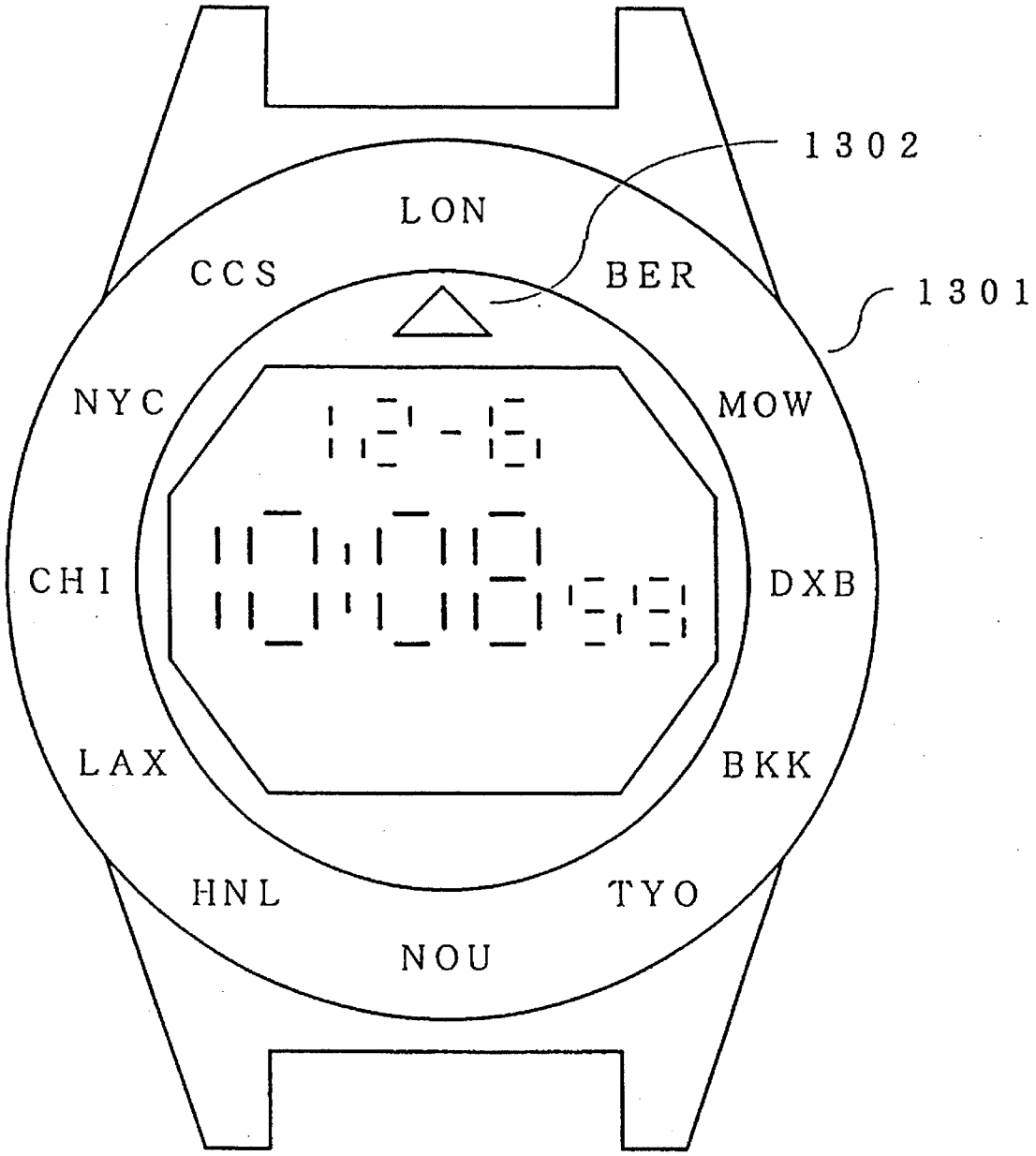
FIG. 13 shows a plain view drawing of an electronic timepiece as is the second embodiment in this invention.

Referring to FIG. 13, LON(London) can be selected, by means of turning the rotary bezel switch 130, and of setting the LON to the city selection mark 132. The local time at the city selected through the city selecting circuit 405 is calculating circuit 406, based on the inputs from the time counting circuit 403 and the date counting circuit 404. The time calculated by the city's 406 is compared by the summer time period comparing circuit 407 with such value as of the starting, the ending, etc. of the summer time by city memorized in the city's summer time date memory circuit 411, and is compensated by the time adjusting circuit 408 in case it is judged that it is in the summer time, and finally is displayed on the LCD panel 409.

Figure 7:
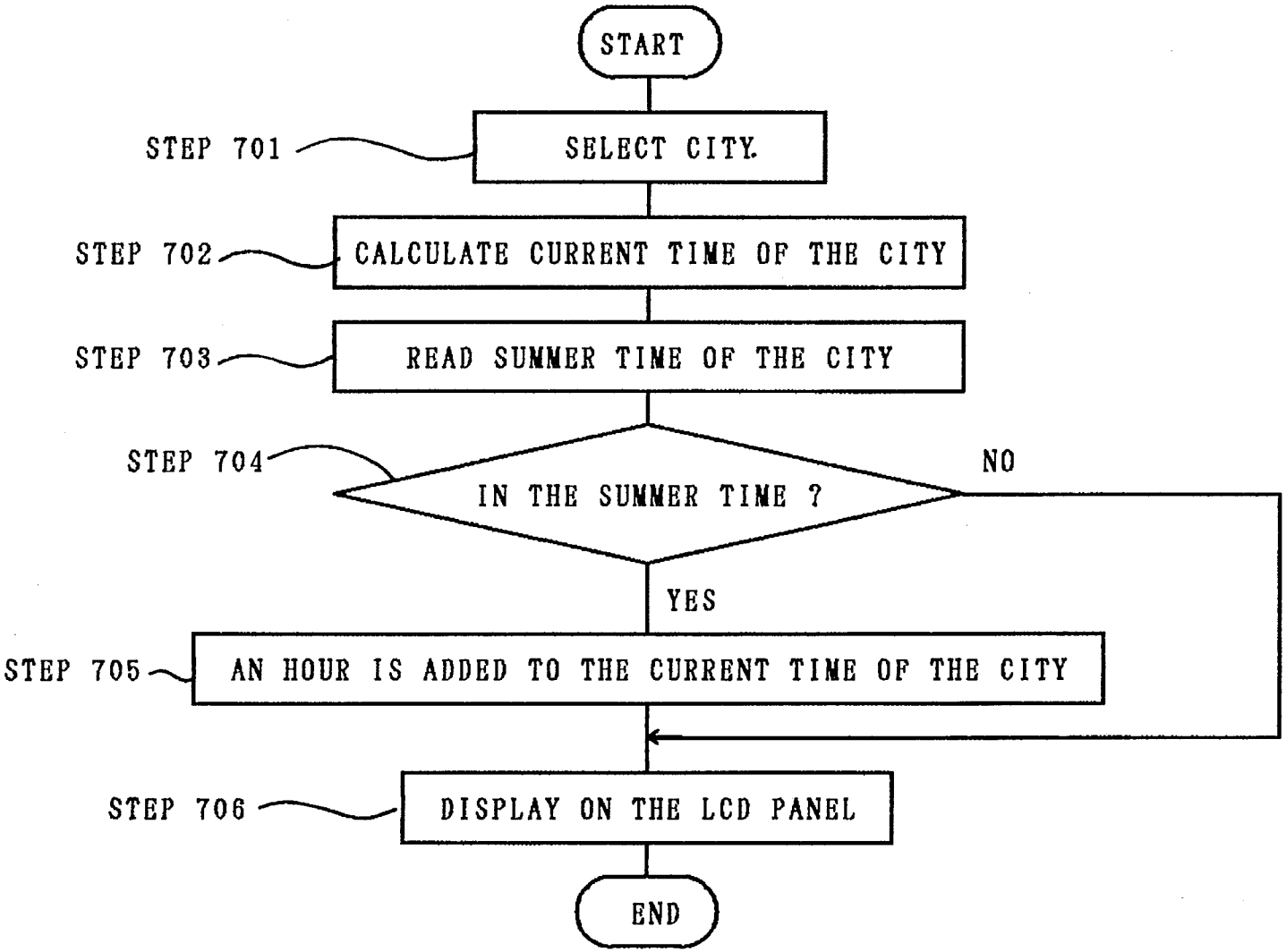
FIG. 7 shows a flow chart of an electronic timepiece as is the second embodiment in this invention.

FIG. 7 shows a flow chart of a digital electronic time piece as is the second embodiment.

In FIG. 7, a city is selected (step 701).

The current time at the city selected as above is calculated (step 702).

The summer time value of the city above is read (step 703).

The current time above is compared with the summer time value above and the activity at step 705 is executed in case that the current time is in the summer time period. Other wise executed is the activity at step 706. (step 704)

An hour is added to the current time of the city in case it is judged at step 704 that it is in the summer time period (step 705).

The current time of the city selected above is displayed on the LCD panel (step 706).

Figure 8:
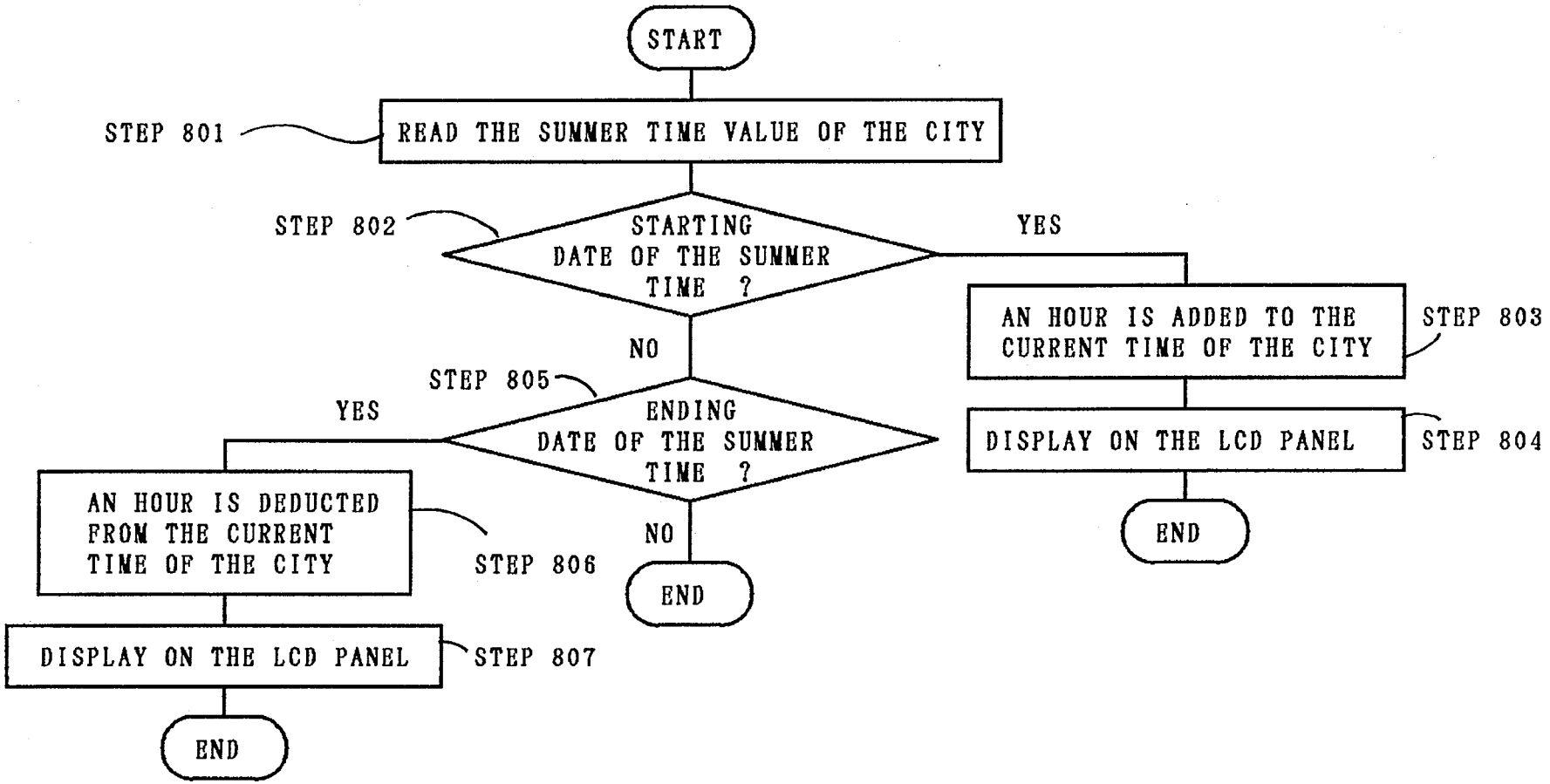
FIG. 8 shows a flow chart of an electronic timepiece as is the second embodiment in this invention.

And the activity shown in the flow chart of FIG. 8, in case the time counted by the time counting circuit 403 and the date counting circuit 404 coincides with the starting or the ending date of the Summer time.

The summer time value of the city selected above is read (step 801).

The activity in step 803 is executed in case the date above coincides with the starting date of the summer time at the city, and otherwise is executed the activity in step 805 (step 802).

An hour is added to the current time at the city in case it is judged in step 802 that the date above coincides with the summer time thereof (step 803).

The current time at the city is displayed in the LCD panel (step 804).

After judged in step 802 that the date does not coincides with the starting date thereof, the activity in step 806 is executed in case it is judged that the date coincides with the ending date of the summer time at city, or otherwise comes to an and the activity (step 805).

An hour is deducted from the city in case judged in step 806 that the date coincides with the ending date of the summer time (step 806).

The current time of the city selected is displayed on the LCD panel (step 804).

(3) The third embodiment.

Figure 9:
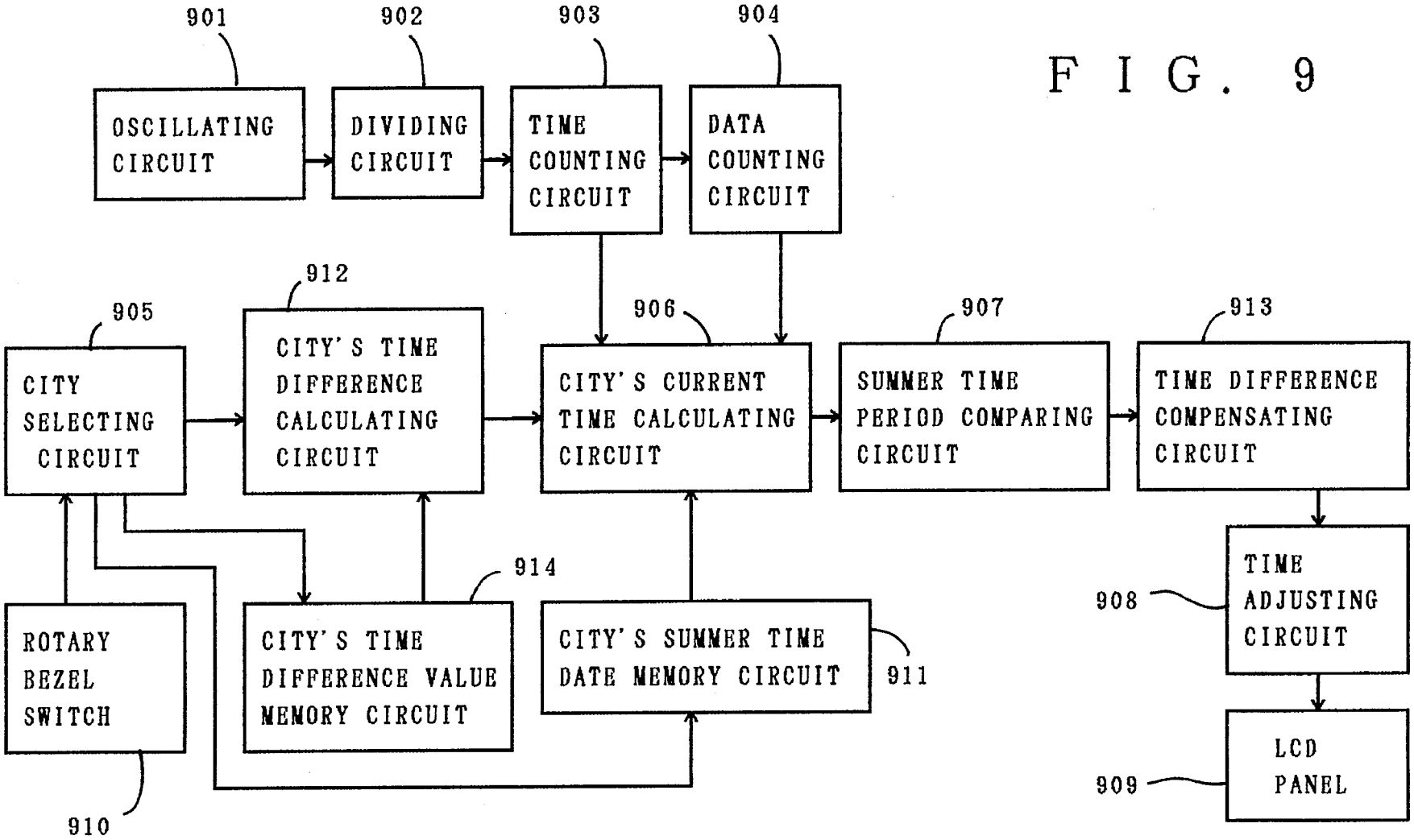
FIG. 9 shows a functional block diagram of an electronic timepiece as is the third embodiment in this invention.
Figure 10:
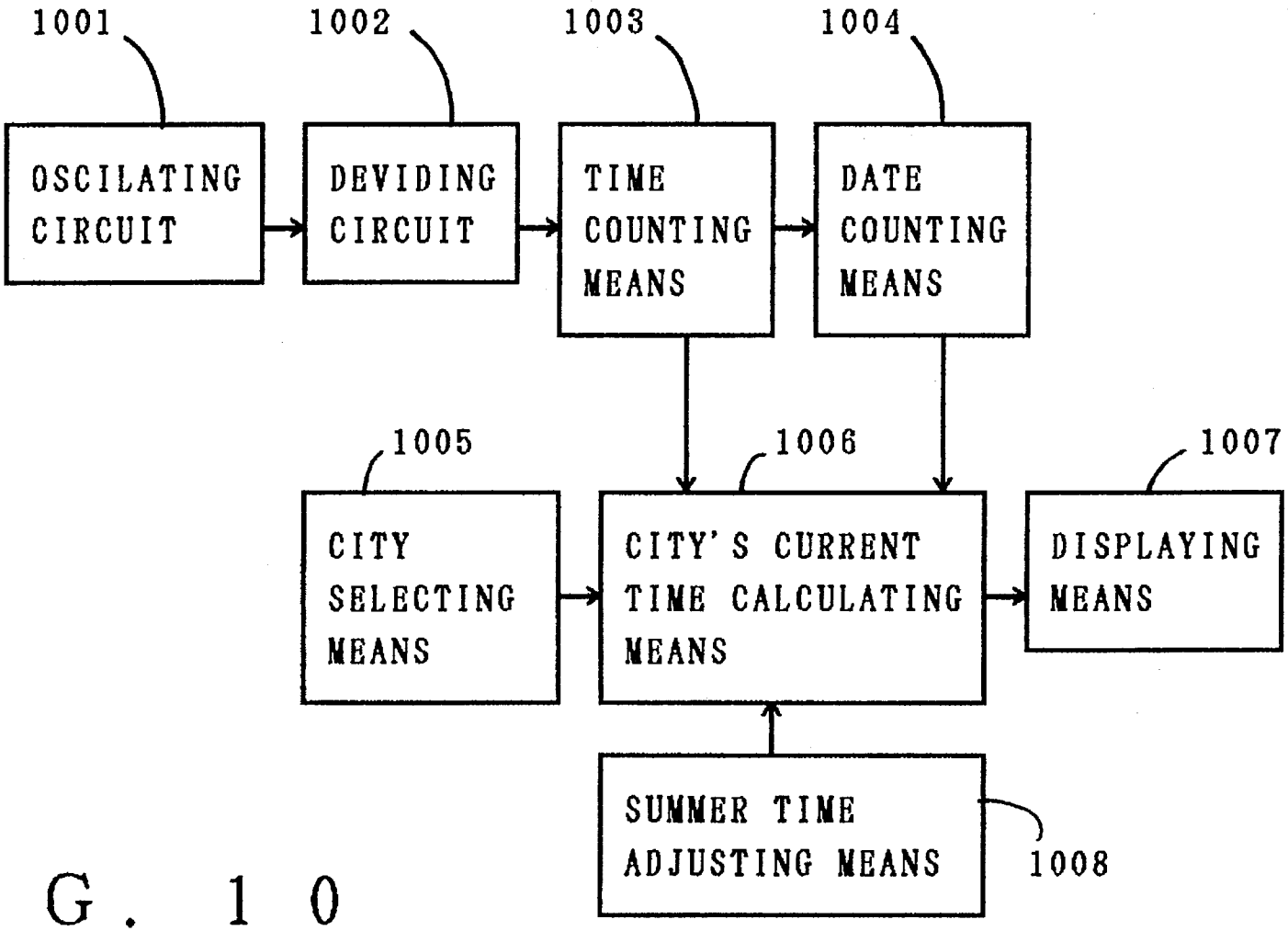
FIG. 10 PRIOR ART
FIG. 10 shows a functional block diagram of an electronic timepiece in prior art.
Figure 11:
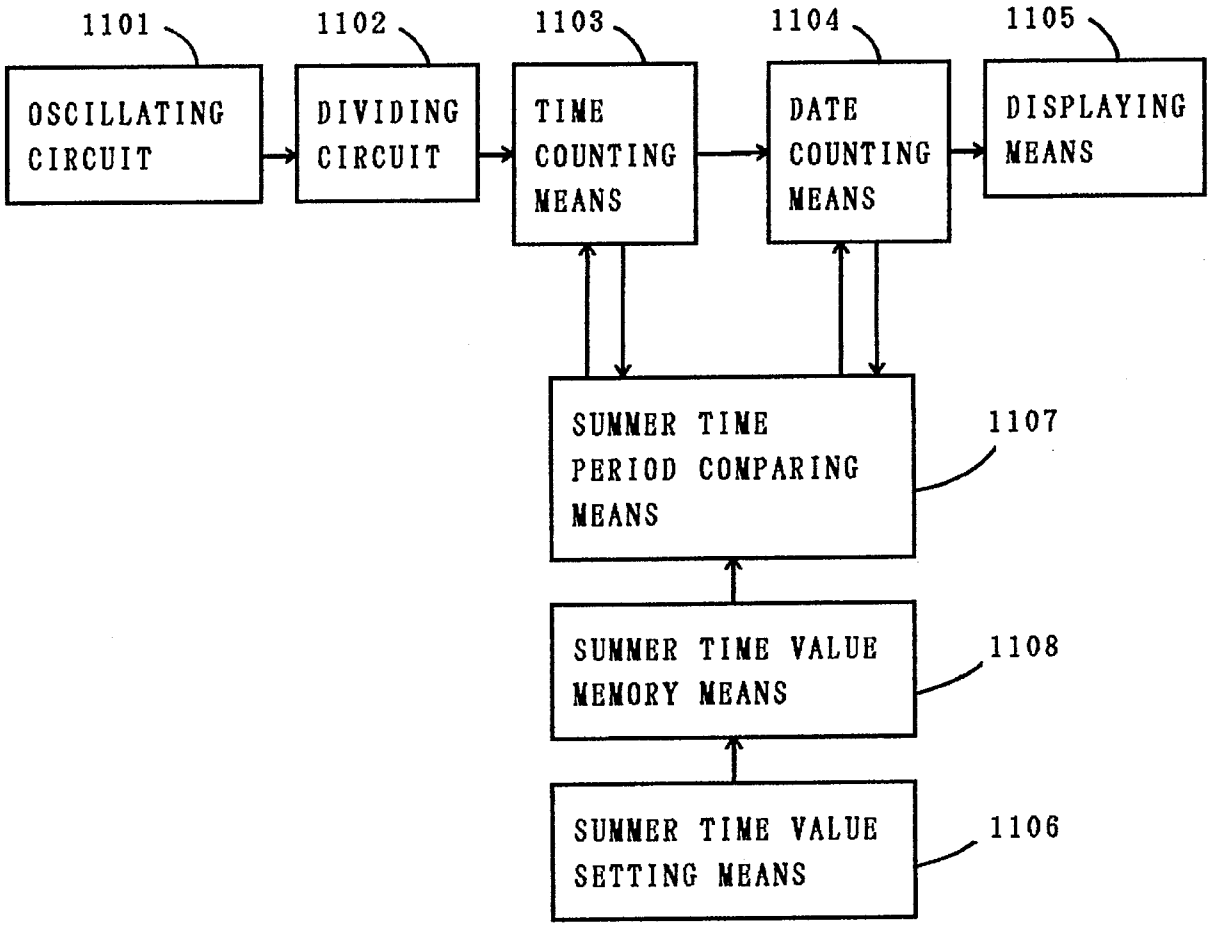
FIG. 11 PRIOR ART
FIG. 11 shows a functional block diagram of an electronic timepiece in prior art.

FIG. 9 shows a block diagram of an digital electronic timepiece as is the second embodiment in this invention.

In FIG. 9, the standard signal from the oscillating circuit 901 is divided by the dividing circuit 902. The time counting circuit 903 counts time with the divided signal. Receiving the date signal from the time counting circuit 903, the date counting circuit 904 counts date.

The city selecting circuit 905 selects a city with the input from the rotary bezel switch 910. Concerning the time difference selected by the city selecting circuit 905, the time difference from the home time is calculated by city's time difference calculating circuit based on the time difference value by city memorized in the city's time difference value memory circuit 914.

The time of the city selected is calculated by the city's current time calculating circuit 906 based on the value from the time counting circuit 903 and the date counting circuit 904. The time of the city calculated by the city's current time calculating circuit 906 is compared by the summer time period comparing circuit 907 with the values such as the starting, the ending, etc. date of the summer time memorized in the city's summer time date memory circuit 911, and in case it is judged that it is in the summer time, the time difference is compensated by the time difference compensating circuit 913 and the time is adjusted by the time adjusting circuit 908, then it is displayed on the LCD panel 909.

(4) The Fourth embodiment.

Figure 16:
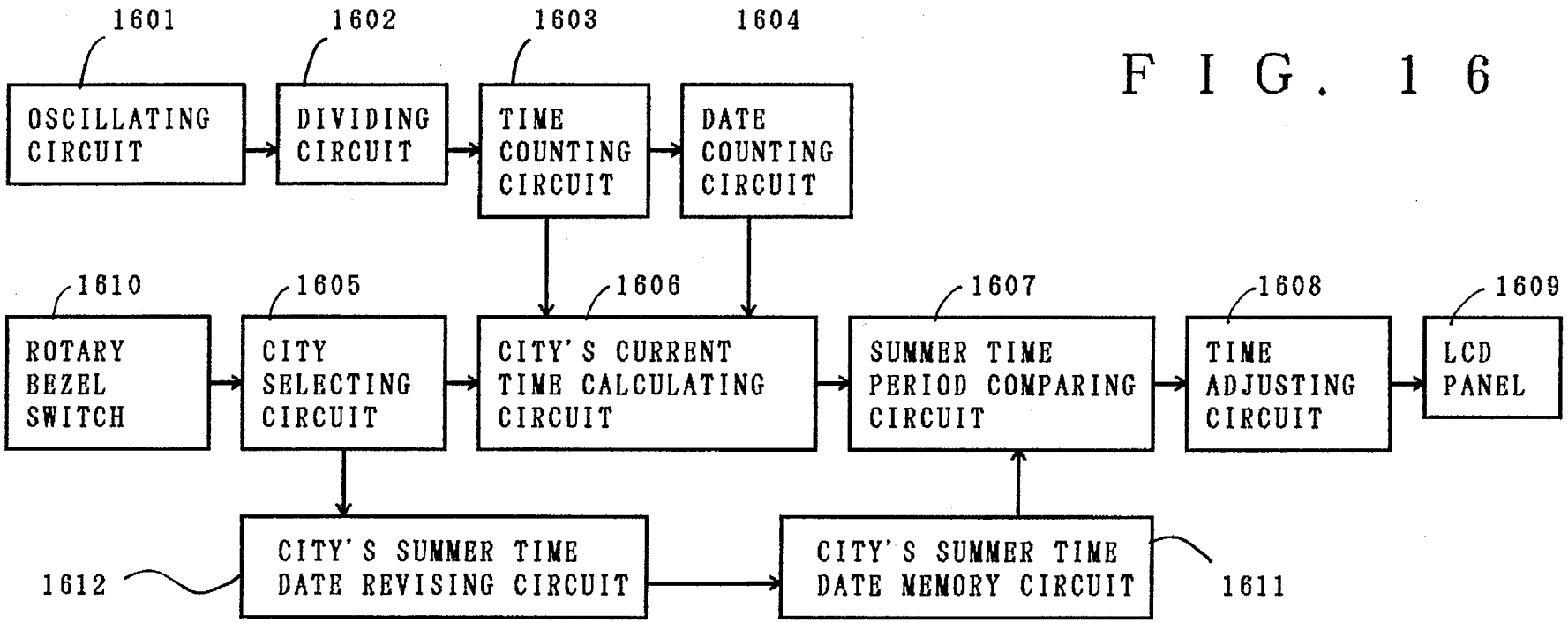
FIG. 16 shows a functional block diagram of an electronic timepiece as is the fourth embodiment in this invention.

FIG. 16 shows a block diagram of a digital electronic timepiece as is the second embodiment in this invention, to which the city's summer time date revising circuit 1612 is added for the case that the starting and/or the ending, date thereof is changed.

In FIG. 16, according to the input from the rotary bezel switch 1610, the city's selecting circuit 1605 selects the city where the starting and/or the ending, date thereof is changed. Such date values of the city selected by the city's selecting circuit 1605 are read from the city's summer time date memory circuit 1611. Such date values are revised to the new date values to the memory by the city's summer time date revising circuit 1612.

As is explained here above according to this invention through keeping the city's summer time date values in the memory, there exists such a merit as correct time of cities is always displayed without any change-over to and from the summer time.

What is claimed is:

1. An electronic timepiece comprising:

a dividing circuit for dividing a standard signal output from an oscillating circuit, time counting means for counting time value, with the output signal from the oscillating circuit, date counting means for counting the date with the output signal from the time counting means, city selecting means for selecting a city, city designating means for displaying the selected city, city's current time calculating means for calculating the local time at the city selected by the city selecting means with the output signal from the time counting means and the output signal from the date counting means, city's summer time date memory means for memorizing such a value as the starting and the ending date of the summer time by city, summer time comparing means for judging if it is in the summer time period through comparing the time counted by the city's time calculating means with the summer time value memorized in the city's summer time date memory means, time adjusting means for adjusting the time in case it is judged by the summer time comparing means that it is in the summer time, and displaying means for displaying the adjusted time above.

2. An electronic timepiece according to claim 1, further comprising;

city's time difference value memory means for memorizing the time difference value by city, city's time difference calculating means for calculating the time difference between the home time and the local time of the city selected by the city selecting means when calculated based on the time difference value memorized in the city's time difference value memory means, and time difference compensating means for compensating the time difference in case judged that it is in the summer time period.

3. An electronic timepiece according to claim 1 or claim 2, further comprising;

a hand for displaying time information or selected city by changing over by a switch.

4. An electronic timepiece according to claim 1 or claim 2, further comprising;

a rotary bezel switch on which multiple number of cities are listed, for outputting a city selection signal for the selected the city of which local time is displayed according to the rotated angle, and displaying the selected city name.

5. An electronic timepiece according to claim 1 or claim 2, further comprising;

a city selecting circuit for selecting the city where the starting and/or the ending date of the summer time is changed, and a city's summer time revising circuit for rewriting the starting and/or the ending date of the summer time in the city's summer time date memory circuit by receiving the output signal from the city selecting circuit.

* * * * *